US008205351B2

(12) United States Patent
Howe et al.

(10) Patent No.: US 8,205,351 B2
(45) Date of Patent: Jun. 26, 2012

(54) DISPENSING VESSEL FOR CLOTHES DRYER

(75) Inventors: William Howe, Indianapolis, IN (US); Richard Payne, Greenwood, IN (US)

(73) Assignee: Edison Nation, LLC, Charlotte, NC (US)

( * ) Notice: Subject to any disclaimer, the term of this patent is extended or adjusted under 35 U.S.C. 154(b) by 0 days.

(21) Appl. No.: 13/091,329

(22) Filed: Apr. 21, 2011

(65) Prior Publication Data

US 2011/0277343 A1 Nov. 17, 2011

Related U.S. Application Data

(63) Continuation of application No. 12/983,724, filed on Jan. 3, 2011, which is a continuation-in-part of application No. 12/228,071, filed on Feb. 20, 2008, now abandoned, and a continuation-in-part of application No. 12/478,659, filed on Jun. 4, 2009, now abandoned.

(60) Provisional application No. 61/058,693, filed on Jun. 4, 2008.

(51) Int. Cl.
*F26B 19/00* (2006.01)

(52) U.S. Cl. ..... 34/60; 34/90; 34/202; 34/227; 34/237; D32/29.1; 68/17 R; 428/139; 428/411; 38/144; 222/1; 424/411; 424/409

(58) Field of Classification Search ..... 34/60, 80, 34/90, 595, 600, 202, 237, 227; 424/409, 424/411; 222/1, 3; 428/138, 411; 68/17 R, 68/19 R; 38/144; D32/29.1
See application file for complete search history.

(56) References Cited

U.S. PATENT DOCUMENTS 2,025,657 A 12/1935 Ganz
2,086,631 A 7/1937 Munro
2,103,083 A 12/1937 Lynch
(Continued)

FOREIGN PATENT DOCUMENTS

CA 134787 10/2010
(Continued)

OTHER PUBLICATIONS

Information Disclosure Statement (IDS) Letter Regarding Common Patent Application(s), dated Jul. 21, 2011.

(Continued)

*Primary Examiner* — Stephen M. Gravini
(74) *Attorney, Agent, or Firm* — Tillman Wright, PLLC; James D. Wright; Chad D. Tillman

(57) ABSTRACT

A dispensing vessel for introducing moisture into a clothes drying environment includes a sponge-like core configured to at least temporarily retain a moistening substance therein, a generally oblong-shaped cover substantially surrounding the core and retaining the core in a compressed condition, and a moistening substance retained within the core. The cover includes a fill opening defined therethrough, the fill opening providing access to an interior of the cover from an exterior of the cover, a plurality of protuberances spaced generally evenly from one another, each protuberance having a generally conical shape, and one or more dispensing openings, each dispensing opening disposed at a distal end of a protuberance of the plurality of protuberances, and each dispensing opening providing access to an exterior of the cover from an interior of the cover. Furthermore, each of the dispensing openings is not positioned generally opposite the fill opening.

18 Claims, 7 Drawing Sheets

U.S. PATENT DOCUMENTS

| | | | | |
|---|---|---|---|---|
| 2,383,470 | A | | 8/1945 | Morgan |
| 2,941,309 | A | | 6/1960 | Cobb |
| 2,956,709 | A | | 10/1960 | Nison et al. |
| 3,411,498 | A | | 11/1968 | Reiter |
| 3,633,538 | A | | 1/1972 | Hoeflin |
| 3,634,947 | A | * | 1/1972 | Furgal ..... 34/60 |
| 3,706,140 | A | | 12/1972 | Brillaud et al. |
| 3,924,807 | A | | 12/1975 | Morgan |
| 4,014,105 | A | | 3/1977 | Furgal et al. |
| 4,057,673 | A | | 11/1977 | Falivene |
| 4,191,178 | A | | 3/1980 | Wisnieski |
| 4,532,719 | A | | 8/1985 | Davies et al. |
| 4,532,722 | A | | 8/1985 | Sax |
| 4,703,872 | A | | 11/1987 | Cornette et al. |
| 4,893,726 | A | | 1/1990 | Vesborg |
| 4,915,267 | A | | 4/1990 | Buecheler et al. |
| 4,920,662 | A | | 5/1990 | Seeburger |
| 5,040,311 | A | | 8/1991 | Roy |
| D319,583 | S | | 9/1991 | Halm et al. |
| 5,072,526 | A | | 12/1991 | Hirota et al. |
| D344,591 | S | | 2/1994 | Zhuang |
| 5,355,541 | A | | 10/1994 | Rutter et al. |
| 5,413,551 | A | | 5/1995 | Wu |
| D369,414 | S | | 4/1996 | Lee |
| D393,671 | S | | 4/1998 | Honaker |
| D396,904 | S | | 8/1998 | Leu |
| D401,365 | S | | 11/1998 | Liu |
| 6,027,573 | A | | 2/2000 | Cercone et al. |
| D431,848 | S | | 10/2000 | Hubbard |
| D435,660 | S | | 12/2000 | Yoo |
| 6,174,577 | B1 | | 1/2001 | Vitorino |
| 6,178,987 | B1 | | 1/2001 | Caruthers, Jr. et al. |
| D444,610 | S | | 7/2001 | Wimp et al. |
| 6,262,004 | B1 | | 7/2001 | Caruthers, Jr. |
| 6,403,551 | B1 | | 6/2002 | Caruthers, Jr. |
| 6,432,071 | B1 | | 8/2002 | Hsieh |
| D473,683 | S | | 4/2003 | Willinger |
| D473,982 | S | | 4/2003 | Clark et al. |
| 6,574,883 | B2 | | 6/2003 | Giblin et al. |
| D478,947 | S | | 8/2003 | Lu |
| 6,689,276 | B2 | | 2/2004 | Caruthers, Jr. |
| 6,887,841 | B2 | * | 5/2005 | Mattia et al. ..... 510/520 |
| D516,261 | S | | 2/2006 | Roberts |
| D575,015 | S | | 8/2008 | Roberts |
| D581,765 | S | | 12/2008 | Lane |
| D583,519 | S | | 12/2008 | Roberts |
| D600,867 | S | | 9/2009 | Howe et al. |
| 7,921,578 | B2 | * | 4/2011 | McAllister et al. ..... 34/597 |
| 2003/0192352 | A1 | | 10/2003 | Wu |
| 2005/0153135 | A1 | | 7/2005 | Popplewell et al. |
| 2006/0288600 | A1 | | 12/2006 | Taylor |
| 2007/0000142 | A1 | | 1/2007 | Breese et al. |
| 2008/0178637 | A1 | * | 7/2008 | Etesse et al. ..... 68/17 R |
| 2009/0165327 | A1 | | 7/2009 | Nekovar |
| 2009/0205218 | A1 | | 8/2009 | Howe |
| 2009/0300933 | A1 | | 12/2009 | Howe et al. |
| 2009/0307924 | A1 | * | 12/2009 | Aouad et al. ..... 34/389 |
| 2010/0044370 | A1 | * | 2/2010 | Barthel et al. ..... 220/4.25 |
| 2010/0263241 | A1 | | 10/2010 | Howe et al. |
| 2011/0186593 | A1 | | 8/2011 | Howe et al. |

FOREIGN PATENT DOCUMENTS

| | | | | |
|---|---|---|---|---|
| GB | 2317378 | A | | 3/1998 |
| GB | 2431908 | A | * | 5/2007 |
| GB | 2468158 | A | * | 9/2010 |
| JP | 05031297 | A | * | 2/1993 |
| JP | 06-046285 | U | | 6/1994 |
| JP | 07178291 | A | * | 7/1995 |
| WO | 02053823 | A1 | | 7/2002 |
| WO | WO 2010049330 | A1 | * | 5/2010 |
| WO | 2010141041 | A1 | | 12/2010 |

OTHER PUBLICATIONS

"International Search Report" and "Written Opinion of the International Search Authority" (Korean Intellectual Property Office) in Edison Nation, LLC, International Patent Application Serial No. PCT/US2009/067879, dated Jul. 1, 2010, 9 pages.

* cited by examiner

DISPENSING VESSEL FOR CLOTHES DRYER

CROSS-REFERENCE TO RELATED APPLICATION

The present application is a U.S. continuation patent application of, and claims priority under 35 U.S.C. §120 to, U.S. patent application Ser. No. 12/983,724, filed Jan. 3, 2011, which '724 application published Aug. 4, 2011 as U.S. patent application publication no. U.S. 2011/0186593 which '724 patent application and any patent application publications thereof are hereby incorporated by reference herein, and which '724 application is a U.S. continuation-in-part patent application of, and claims priority under 35 U.S.C. §120 to, the following patent applications:

(a) U.S. nonprovisional patent application Ser. No. 12/228,071, which '071 application was converted to a nonprovisional patent application from U.S. provisional patent application No. 61/030,219, filed Feb. 20, 2008, now abandoned which '071 application published Aug. 20, 2009 as U.S. patent application publication no. US 2009/0205218 A1, and which '071 application and any patent application publications thereof are hereby incorporated by reference herein; and (b) U.S. nonprovisional patent application Ser. No. 12/478,659, filed Jun. 4, 2009, now abandoned which '659 application published Dec. 10, 2009 as U.S. patent application publication no. US 2009/0300933 A1, which '659 patent application and any patent application publications thereof are hereby incorporated by reference herein, and which '659 application is a nonprovisional patent application of, and claims priority under 35 U.S.C. §119(e) to, U.S. provisional patent application Ser. No. 61/058,693, filed Jun. 4, 2008, which '693 application is hereby incorporated by reference herein.

COPYRIGHT STATEMENT

All of the material in this patent document is subject to copyright protection under the copyright laws of the United States and other countries. The copyright owner has no objection to the facsimile reproduction by anyone of the patent document or the patent disclosure, as it appears in official governmental records but, otherwise, all other copyright rights whatsoever are reserved.

BACKGROUND OF THE INVENTION

The present invention generally relates to a vessel for dispensing steam or moisture into a clothes drying environment, and particularly to a vessel for dispensing steam or moisture to a batch of clothes that has been left in a clothes dryer for a period of time following termination of the drying cycle.

For many families and individuals, the task of washing and drying clothing, towels, and other articles is ongoing. Quite often, as one batch of clothing articles is completed, another is ready to begin. Even with the aid of advanced washing machines and clothes dryers, washing and drying clothing articles can become an obligation that quickly fills an entire day. Washing and drying cycles for conventional washing machines and clothes dryers can have varied lengths, depending on the size of the batch of clothing articles to be washed and dried. Inevitably, busy families and individuals can lose track of the status of a batch of clothing articles during one of these cycles. As a result, it is not at all uncommon for a batch of clothing articles to sit unattended in a washing machine or clothes dryer following termination of the corresponding cycle.

In particular, with respect to the drying component of the overall process, a batch of clothing articles that is left unattended following termination of the drying cycle can become wrinkled, matted, or clumped together if left for a prolonged period of time. When this occurs, individual clothing articles may be virtually unusable without being refreshed. In order to refresh the batch of clothing articles following termination of the drying cycle, individuals may consider restarting the drying cycle so as to "fluff" the batch of clothing articles before removal from the clothes dryer. However, such attempts to refresh often do not assist with the removal of wrinkles from individual articles because the batch of clothing articles is already dry. As such, a need exists for a device or method that is capable of refreshing a batch of clothing articles that has been left in a clothes dryer for a period of time following termination of the drying cycle.

Conventional drying aids, such as dryer sheets and dryer balls, are intended for use in connection with a batch of clothing articles at the beginning of the drying cycle when the clothing articles are still wet from the washing cycle. Dryer sheets typically assist with softening the underlying fabric of the clothing articles and may reduce static between individual clothing articles during the drying cycle. Dryer balls typically facilitate greater air flow between clothing articles during the drying cycle, thereby enhancing the drying process by increasing air circulation in the clothes dryer. However, these conventional drying aids are unable to assist in refreshing or removing wrinkles from a batch of clothing articles that is already dry.

Therefore, a need exists for improvement in the field of drying aids for conventional clothes dryers, and particularly in connection with refreshing a batch of clothing articles that has been left in a clothes dryer for a period of time following termination of the drying cycle. This, and other needs, is addressed by one or more aspects of the present invention.

SUMMARY OF THE INVENTION

The present invention includes many aspects and features. Moreover, while many aspects and features relate to, and are described in, the context of dispensing vessels for clothes dryers, the present invention is not limited to use only in connection with dispensing vessels for clothes dryers, as will become apparent from the following summaries and detailed descriptions of aspects, features, and one or more embodiments of the present invention.

Accordingly, one aspect of the present invention relates to a dispensing vessel for introducing moisture to a clothes drying environment. An exemplary such dispensing vessel includes a core and a cover substantially surrounding the core. In this aspect of the invention, the core is comprised of a sponge-like material for at least temporarily retaining a moistening substance within the core. Additionally, the cover has at least one opening extending through to the core for permitting the release of moisture to the clothes drying environment. As used herein, the term "moisture" may refer to liquids, gases, or combinations thereof.

In features of this aspect of the invention, the dispensing vessel may further include one or more protuberances; each of the one or more protuberances may have a flattened tip; the moistening substance may be a deodorizing substance; the moistening substance may be a scented substance; and the cover may have a generally spherical shape.

Another aspect of the invention relates to a method of using a dispensing vessel for introducing moisture to a clothes drying environment, wherein the dispensing vessel includes a core and a cover substantially surrounding the core. An exemplary such method includes introducing a moistening substance to the core of the dispensing vessel, placing the dispensing vessel in a clothes dryer with a batch of clothing articles, and configuring the clothes dryer to operate at a heat setting. Moisture is released from the core of the dispensing vessel to the clothes drying environment via at least one opening in the cover of the dispensing vessel. As used herein, the phrase "clothing articles" may refer to clothing, towels, accessory garments, or related articles.

In features of this aspect, the core may be comprised of a sponge-like material; the dispensing vessel may further comprise one or more protuberances; each of the one or more protuberances may have a flattened tip; the moistening substance may be a deodorizing substance; the moistening substance may be a scented substance; and the cover may have a generally spherical shape.

Still another aspect of the invention relates to a dispensing vessel for introducing moisture to a clothes drying environment. An exemplary such dispensing vessel includes a core comprised of a sponge-like material for at least temporarily retaining a moistening substance within the core; a cover substantially surrounding the core, the cover having a plurality of dispensing openings extending through to the core for permitting the release of moisture to the clothes drying environment and a fill opening arranged at an upper portion thereof; and a plurality of protuberances arranged exteriorly of the cover, wherein at least one of the protuberances has a flattened tip.

In features of this aspect, the moistening substance may be a deodorizing substance; the moistening substance may be a scented substance; the cover may have a generally spherical shape; each of the dispensing openings may be positioned at or near the upper portion of the cover; each of the dispensing openings may be positioned at corresponding protuberances; and each of the protuberances may be a separable component that is attachable to the cover.

Still yet another aspect of the invention relates to a method of using a dispensing vessel for introducing moisture to a clothes drying environment, wherein the dispensing vessel includes a core, a cover substantially surrounding the core, and a plurality of protuberances arranged exteriorly of the cover. An exemplary such method includes introducing a moistening substance to the core of the dispensing vessel through a fill opening in the cover; placing the dispensing vessel in a clothes dryer with a batch of clothing articles; and configuring the clothes dryer to operate at a heat setting. Moisture is released from the core of the dispensing vessel to the clothes drying environment via at least one opening in the cover of the dispensing vessel.

In features of this aspect, at least one of the protuberances may have a flattened tip; the moistening substance may be a deodorizing substance; the moistening substance may be a scented substance; the cover may have a generally spherical shape; each of the dispensing openings may be positioned at or near an upper portion of the cover; each of the dispensing openings may be positioned at corresponding protuberances; and each of the protuberances may be a separable component that is attachable to the cover.

Another aspect of the present invention relates to a dispensing vessel for deodorizing articles in a clothes drying environment. The dispensing vessel includes a core configured to at least temporarily retain a moistening substance therein; and a cover substantially surrounding the core, the cover including a fill opening defined therethrough, the fill opening providing access to an interior of the cover from an exterior of the cover, one or more dispensing openings, each dispensing opening providing access to an exterior of the cover from an interior of the cover; and a deodorizing substance retained within said core.

In a feature of this aspect of the invention, the cover has a generally spherical shape.

In a feature of this aspect of the invention, the cover is comprised of a semi-rigid material.

In a feature of this aspect of the invention, each of the dispensing openings is not positioned generally opposite the fill opening.

In a feature of this aspect of the invention, the cover includes a plurality of protuberances, each protuberance including a flattened tip at a distal end thereof.

In a feature of this aspect of the invention, the plurality of protuberances are spaced generally evenly from one another.

In a feature of this aspect of the invention, the deodorizing substance is scented.

Another aspect of the present invention relates to a dispensing vessel for deodorizing articles in a clothes drying environment. The dispensing vessel includes a core configured to at least temporarily retain a moistening substance therein; and a cover substantially surrounding the core, the cover including a plurality of protuberances, each protuberance including a flattened tip at a distal end thereof, a fill opening defined therethrough, the fill opening providing access to an interior of the cover from an exterior of the cover, one or more dispensing openings, each dispensing opening being disposed proximate the flattened tip of a protuberance of the plurality of protuberances, and each dispensing opening providing access to an exterior of the cover from an interior of the cover; and a deodorizing substance retained within said core.

Another aspect of the present invention relates to a method of using a dispensing vessel for introducing moisture to a clothes drying environment, the dispensing vessel comprising a core and a cover substantially surrounding the core which includes a plurality of protuberances. The method includes introducing a deodorizing substance to the core of the dispensing vessel through a fill opening in the cover; placing the dispensing vessel in a clothes dryer with one or more clothing articles; and operating the clothes dryer at a heat setting; wherein moisture is released from the core of the dispensing vessel to the clothes drying environment via at least one dispensing opening in the cover of the dispensing vessel.

In a feature of this aspect of the invention, the deodorizing substance is a moistening substance.

In a feature of this aspect of the invention, wherein the method further comprises, prior to placing the dispensing vessel in the clothes dryer, the step of introducing a moistening substance.

In addition to the aforementioned aspects and features of the present invention, it should be noted that the present invention further encompasses the various possible combinations of such aspects and features.

BRIEF DESCRIPTION OF THE DRAWINGS

One or more preferred embodiments of the present invention now will be described in detail with reference to the accompanying drawings, wherein the same elements are referred to with the same reference numerals, and wherein.

DETAILED DESCRIPTION

Figure 1:
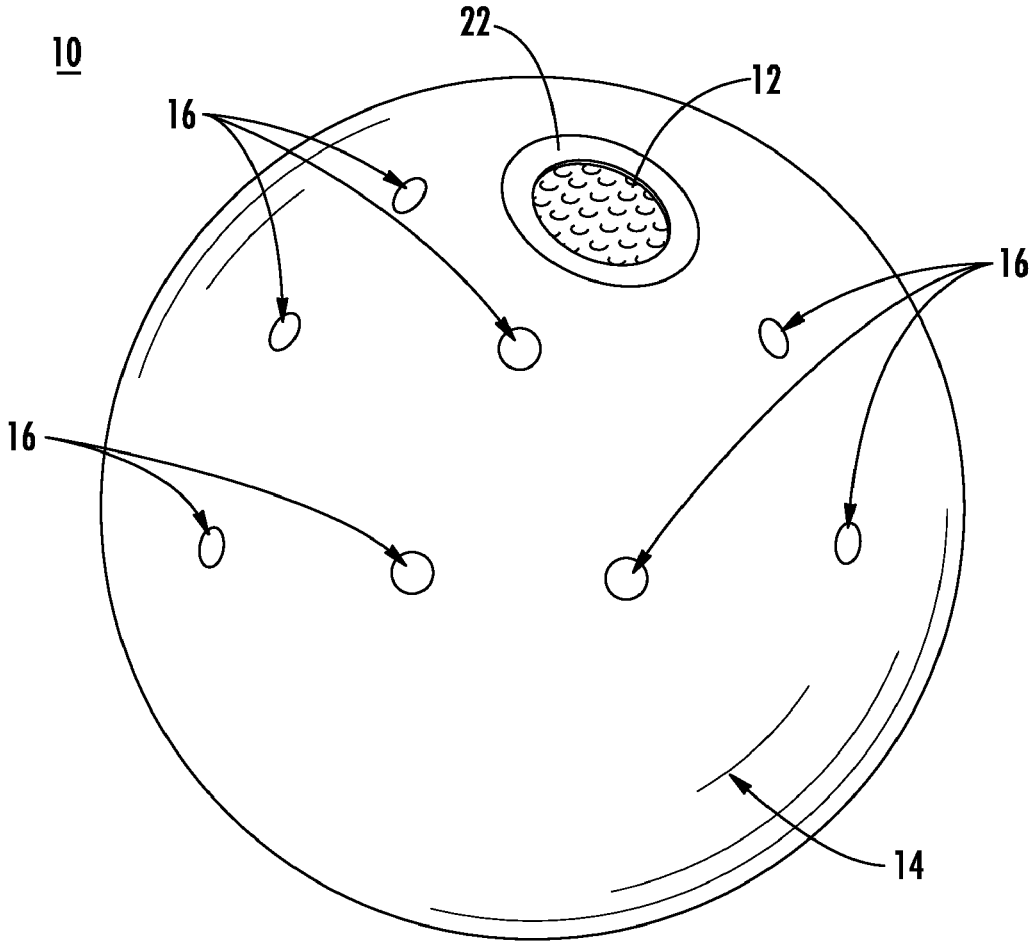
FIG. 1 is a perspective view of an embodiment of a dispensing vessel in accordance with one or more aspects of the present invention.
Figure 2:
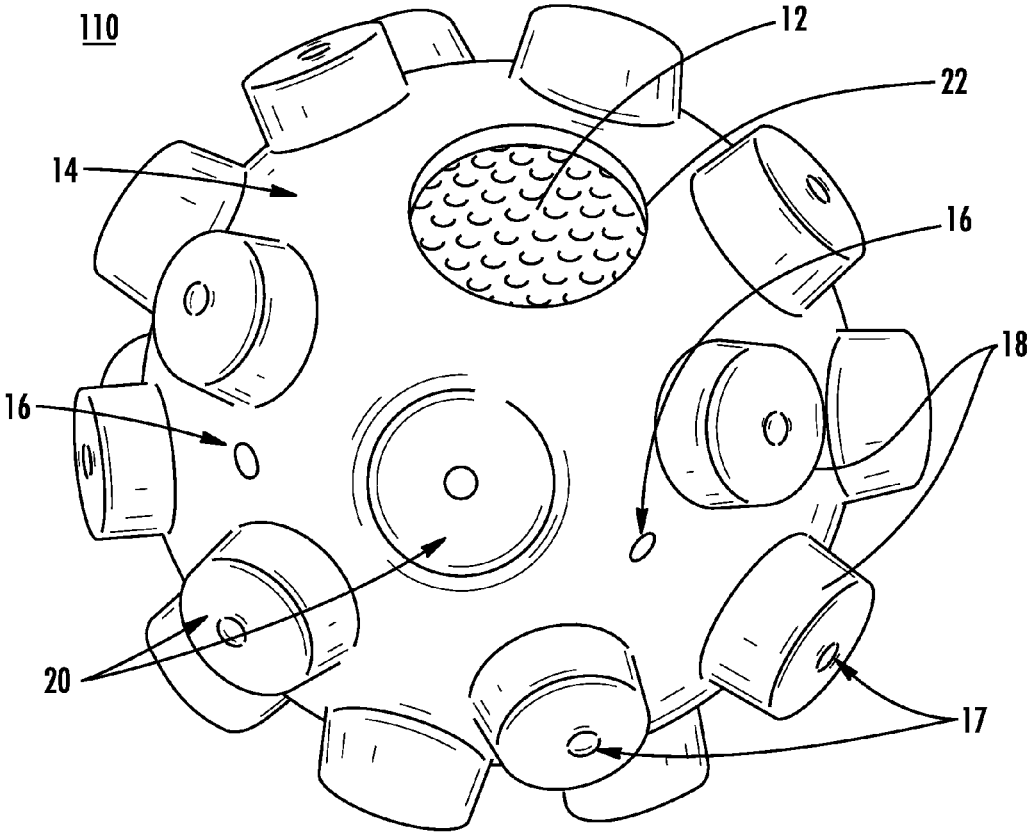
FIGS. 2-7 are perspective views of another embodiment of a dispensing vessel in accordance with one or more aspects of the present invention.
Figure 3:
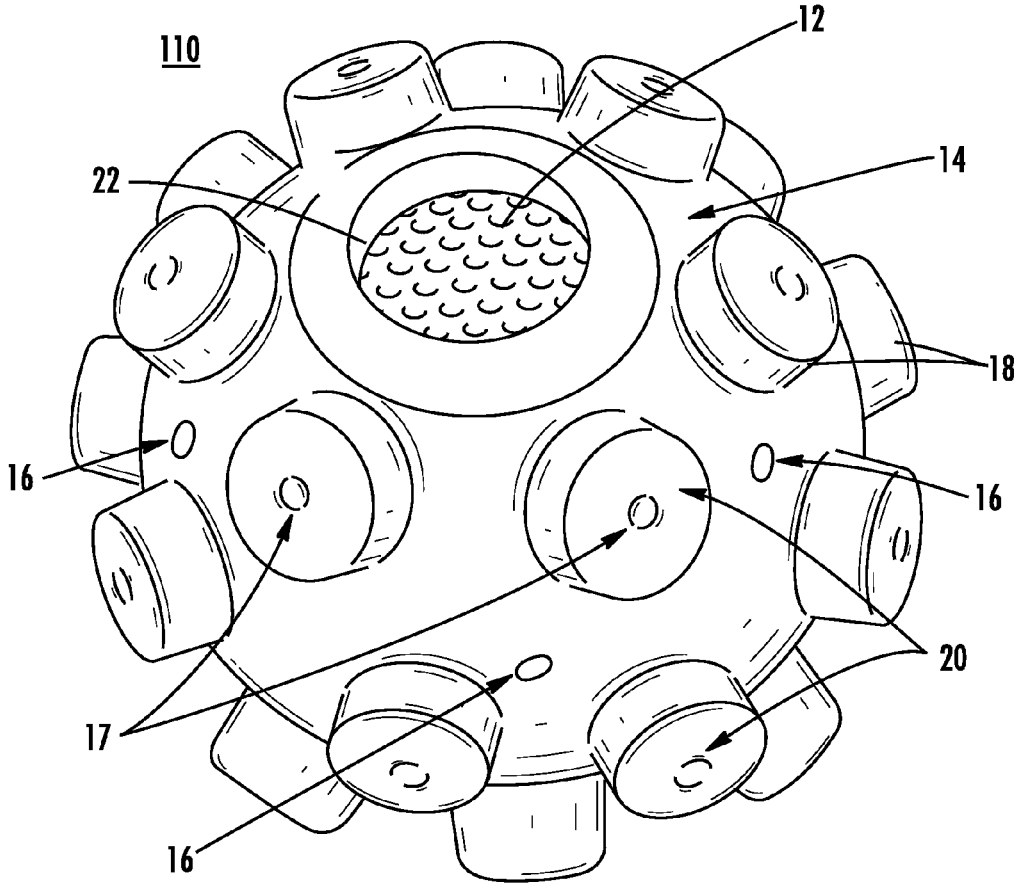
Figure 4:
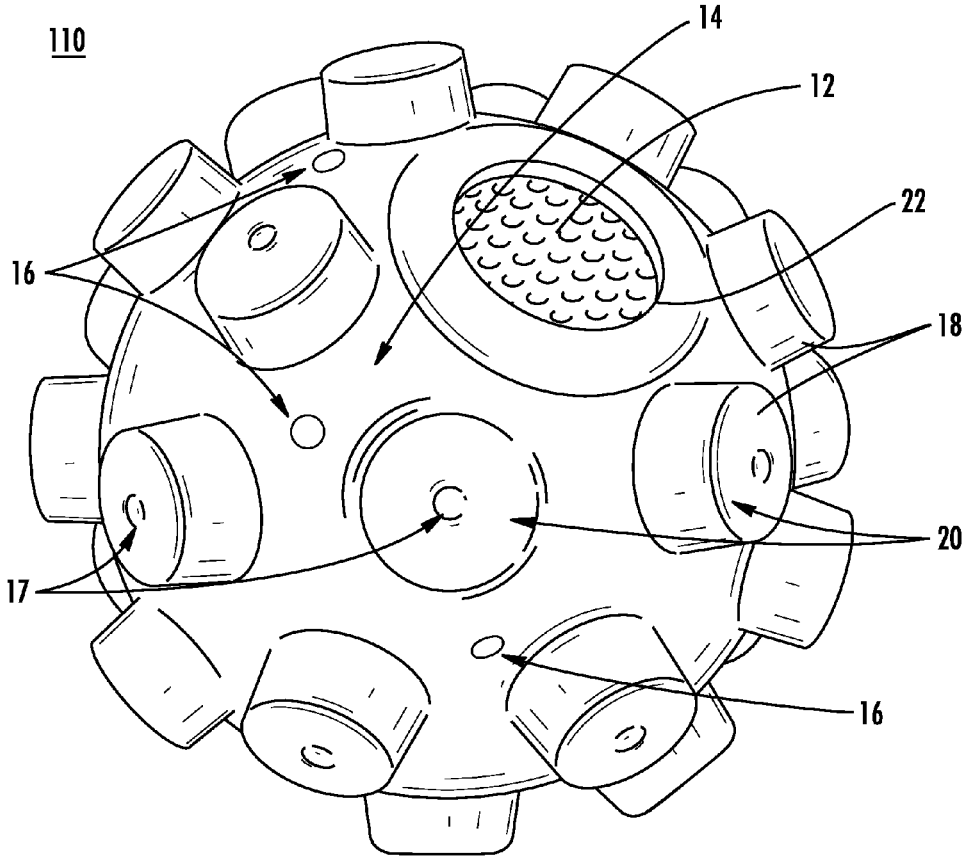
Figure 5:
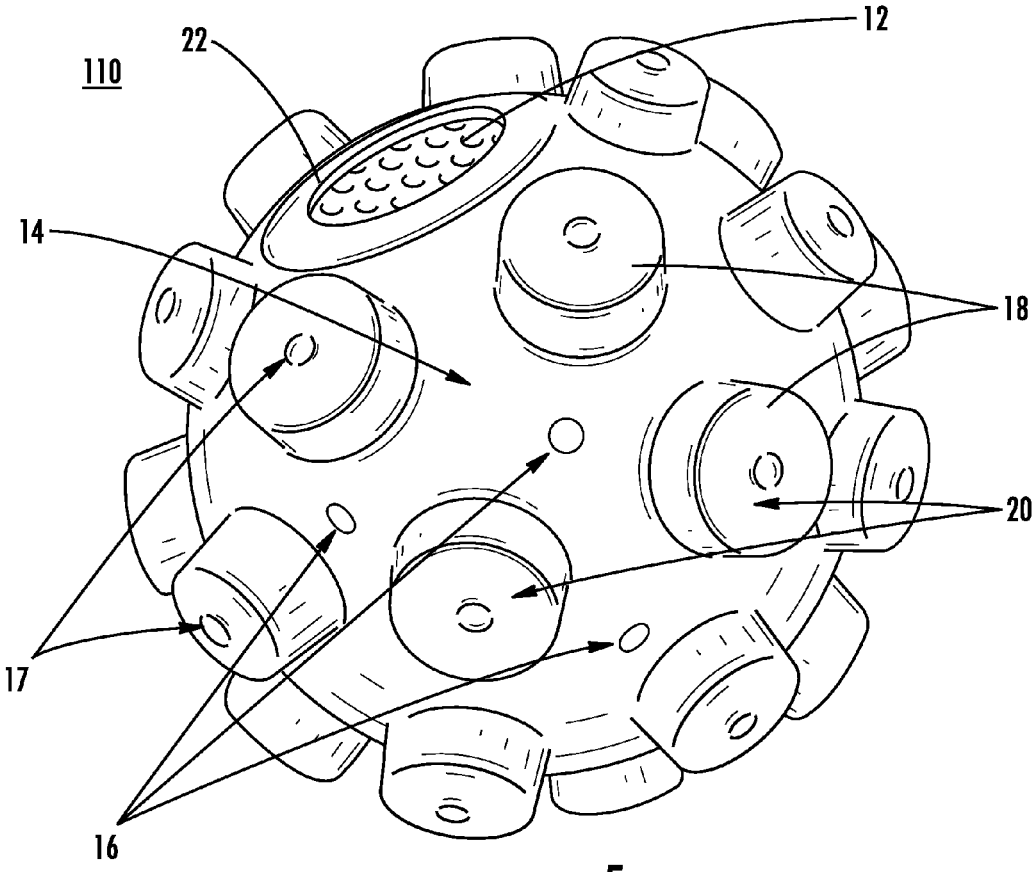

As a preliminary matter, it will readily be understood by one having ordinary skill in the relevant art ("Ordinary Artisan") that the present invention has broad utility and application. Furthermore, any embodiment discussed and identified as being "preferred" is considered to be part of a best mode contemplated for carrying out the present invention. Other embodiments also may be discussed for additional illustrative purposes in providing a full and enabling disclosure of the present invention. As should be understood, any embodiment may incorporate only one or a plurality of the above-disclosed aspects of the invention and may further incorporate only one or a plurality of the above-disclosed features. Moreover, many embodiments, such as adaptations, variations, modifications, and equivalent arrangements, will be implicitly disclosed by the embodiments described herein and fall within the scope of the present invention.

Accordingly, while the present invention is described herein in detail in relation to one or more embodiments, it is to be understood that this disclosure is illustrative and exemplary of the present invention, and is made merely for the purposes of providing a full and enabling disclosure of the present invention. The detailed disclosure herein of one or more embodiments is not intended, nor is to be construed, to limit the scope of patent protection afforded the present invention, which scope is to be defined by the claims and the equivalents thereof. It is not intended that the scope of patent protection afforded the present invention be defined by reading into any claim a limitation found herein that does not explicitly appear in the claim itself.

Thus, for example, any sequence(s) and/or temporal order of steps of various processes or methods that are described herein are illustrative and not restrictive. Accordingly, it should be understood that, although steps of various processes or methods may be shown and described as being in a sequence or temporal order, the steps of any such processes or methods are not limited to being carried out in any particular sequence or order, absent an indication otherwise. Indeed, the steps in such processes or methods generally may be carried out in various different sequences and orders while still falling within the scope of the present invention. Accordingly, it is intended that the scope of patent protection afforded the present invention is to be defined by the appended claims rather than the description set forth herein.

Additionally, it is important to note that each term used herein refers to that which the Ordinary Artisan would understand such term to mean based on the contextual use of such term herein. To the extent that the meaning of a term used herein—as understood by the Ordinary Artisan based on the contextual use of such term—differs in any way from any particular dictionary definition of such term, it is intended that the meaning of the term as understood by the Ordinary Artisan should prevail.

Regarding applicability of 35 U.S.C. §112, ¶6, no claim element is intended to be read in accordance with this statutory provision unless the explicit phrase "means for" or "step for" is actually used in such claim element, whereupon this statutory provision is intended to apply in the interpretation of such claim element.

Furthermore, it is important to note that, as used herein, "a" and "an" each generally denotes "at least one," but does not exclude a plurality unless the contextual use dictates otherwise. Thus, reference to "a picnic basket having an apple" describes "a picnic basket having at least one apple" as well as "a picnic basket having apples." In contrast, reference to "a picnic basket having a single apple" describes "a picnic basket having only one apple."

When used herein to join a list of items, "or" denotes "at least one of the items," but does not exclude a plurality of items of the list. Thus, reference to "a picnic basket having cheese or crackers" describes "a picnic basket having cheese without crackers", "a picnic basket having crackers without cheese", and "a picnic basket having both cheese and crackers." Finally, when used herein to join a list of items, "and" denotes "all of the items of the list." Thus, reference to "a picnic basket having cheese and crackers" describes "a picnic basket having cheese, wherein the picnic basket further has crackers," as well as describes "a picnic basket having crackers, wherein the picnic basket further has cheese."

As used herein, the specific term "moisture" may refer to liquids, gases, or combinations thereof. Additionally, as used herein, the specific phrase "clothing articles" may refer to clothing, towels, accessory garments, or related articles.

Referring now to the drawings, one or more preferred embodiments of the present invention are next described. The following description of one or more preferred embodiments is merely exemplary in nature and is in no way intended to limit the invention, its implementations, or uses.

Turning now to FIG. 1, an embodiment of a dispensing vessel 10 in accordance with one or more aspects of the present invention is shown. The dispensing vessel 10 includes a core 12 and a cover 14. The core 12 is preferably composed of a sponge-like material that is capable of absorbing and at least temporarily retaining a moistening substance. The cover 14 substantially surrounds the core 12 and includes at least one dispensing opening 16 that extends through to the core 12 of the dispensing vessel 10. As will be explained in greater detail below, when the dispensing vessel 10 is in use in a clothes drying environment, moisture is permitted to pass from the core 12 to the clothes drying environment via the at least one opening 16.

As shown in FIG. 1, the cover 14 of the dispensing vessel 10 may have a generally spherical shape, thereby providing the dispensing vessel 10 itself with a generally spherical shape. Although a spherical shape is shown, other shapes are also contemplated, such as an oblong shape or a cube shape. The cover 14 of the dispensing vessel 10 may be composed of any material that might be preferred. Advantageously, the cover 14 may be composed of a durable material that is capable of withstanding the high heat typically associated with conventional clothes dryers, such as a durable plastic or rubber material. The cover 14 may also be configured to have a rigid or semi-rigid character. The core 12 may be composed of any material that provides the ability to retain a moistening substance at least temporarily, such as a sponge or sponge-like material.

As further shown in FIG. 1, the dispensing vessel 10 may include a fill opening 22 to provide an entry portal through which a moistening substance may be added to the core 12. The fill opening 22 may be any particular size as might be preferred. In at least some preferred implementations, the fill opening 22 is sufficiently large so as to permit the core 12 of the dispensing vessel 10 to be removed or replaced. Removal or replacement of the core 12 may become necessary following repeated usage of the dispensing vessel or if the material comprising the core 12 becomes soiled or worn. However, in some preferred implementations, the fill opening 22 is not configured to permit removal of the core 12, although it will be appreciated that withdrawal or removal of the core 12 may still be possible.

A cap or lid (not shown) may also be included so as to provide a means of selectively sealing the fill opening 22 after the moistening substance is added to the core 12. The moistening substance may be any particular substance that can be added to the core 12 in order to provide moisture. Preferably, the moistening substance is a liquid that may be poured into the dispensing vessel 10 through the fill opening 22 to the core 12. As the dispensing vessel 10 is filled, the sponge-like material of the core 12 absorbs and at least temporarily retains the moistening substance. Additives may be included in the moistening substance to convey desired properties thereto as might be preferred. For instance, a scented substance may be added to the moistening substance so as to add a desired scent to a batch of clothing articles. Further, the moistening substance may itself be a scented substance. The scented substance may overpower any unpleasant odor that exists in a batch of clothing articles in the clothes dryer, thereby permitting the batch of clothing articles to smell refreshed and pleasant following use of the dispensing vessel 10. Additionally, a deodorizing substance may be added to the moistening substance in order to facilitate the removal of odor from a batch of clothing articles. It is also contemplated that the moistening substance may itself have deodorizing properties. The deodorizing substance may thus permit any odor associated with a batch of clothing articles in the clothes dryer to be eliminated following use of the dispensing vessel 10. It will be appreciated that, in accordance with this description, one or more substances that are moistening, scented, or deodorizing may be utilized.

As further shown in FIG. 1, at least one dispensing opening 16 may be arranged on the cover 14 that extends through to the core 12 of the dispensing vessel 10. While any number of dispensing openings 16 may be incorporated in the dispensing vessel 10, FIG. 1 depicts a plurality of dispensing openings 16 spaced along the cover 14 at relatively even intervals. The size of the at least one dispensing opening 16 may vary. Preferably, the size of the at least one dispensing opening 16 is not so large as to permit immediate spillage of the moistening substance from the core 12. In at least some preferred implementations, no dispensing openings 16 are included generally opposite of the fill opening 22. In particular, each of the dispensing openings 16 may be positioned at or near the fill opening 22 in an upper portion of the dispensing vessel 10. In this regard, the moistening substance added to the core 12 through the fill opening 22 is less likely to seep out of the dispensing vessel 10 prior to use.

In a method of use of the dispensing vessel 10, a moistening substance may be introduced to the core 12 through the fill opening 22. If a cap or lid is present, the cap or lid may be affixed to the cover 14 so as to seal the fill opening 22, thereby helping to prevent spillage of the moistening substance. The moistening substance is absorbed and at least temporarily retained by the sponge-like material of the core 12. Optionally, an additive may be included in the moistening substance or added to the core 12 separately in order to provide the moistening substance with a desired property, such as a specific scent or a deodorizing feature. In addition to the foregoing, it is also contemplated that the moistening substance may itself be a scented substance, may have deodorizing properties, or both. The filled dispensing vessel 10 may then be placed in a clothes dryer with a batch of articles, such as, for example, clothing articles. In a preferred aspect of the method, the batch of clothing articles has previously completed a drying cycle in the clothes dryer and has been left in the clothes dryer for a period of time following termination of the drying cycle, after which time the batch of clothing articles may have become wrinkled, matted, or clumped together.

Following placement of the filled dispensing vessel 10 in the clothes dryer, the clothes dryer is configured to a drying cycle with a heat setting. During the drying cycle, moisture is released from the core 12 of the dispensing vessel 10 to the clothes drying environment through the at least one opening 16 in the cover 14 of the dispensing vessel 10. Moisture from the dispensing vessel 10 thereby assists with the removal of wrinkles from individual articles in the batch of clothing articles. Additionally, if a scented additive is included with the moistening substance or the moistening substance itself is a scented substance, the dispensing vessel 10 may simultaneously impart the desired scent to the batch of clothing articles in the clothes dryer, which may further refresh the batch of clothing articles. Similarly, if a deodorizing substance is added to the moistening substance or the moistening substance itself has deodorizing properties, the dispensing vessel 10 may simultaneously remove any odor associated with a batch of clothing articles in the clothes dryer. In a preferred aspect of the method, a high level of heat from the drying cycle of the clothes dryer may facilitate moisture being released from the dispensing vessel 10 as steam, which may enhance the removal of wrinkles. Additionally, a plurality of dispensing vessels 10 may be used simultaneously in connection with a large batch of clothing articles.

The dispensing vessel 10 may thus be used to provide moisture to the clothes drying environment. Use of the dispensing vessel 10 may assist with the removal of wrinkles from a batch of clothing articles and otherwise refresh the batch of clothing articles following termination of the drying cycle.

Turning now to FIGS. 2-7, another embodiment of a dispensing vessel 110 in accordance with one or more aspects of the present invention is shown. The dispensing vessel 110 may include one or more protuberances 18. The one or more protuberances may be formed as an integral component of the cover 14, as illustrated in FIGS. 2-7, or the one or more protuberances may be attached to the cover 14 as separate, individual components. In the event that separate components are utilized, individual protuberances may be replaced as needed if damage occurs or if differently shaped protuberances are desired. As with the cover 14, the composition of the protuberances 18 may vary. Preferably, the one or more protuberances 18 are each composed of a durable material that is capable of withstanding the high heat typically associated with conventional clothes dryers, such as a durable plastic or rubber material. Preferably, the one or more protuberances 18 are composed of the same material as the cover 14.

The one or more protuberances 18 may be shaped so as to facilitate air flow between clothing articles in a clothes drying environment, such as a conventional clothes dryer. As shown in FIGS. 2-7, the one or more protuberances 18 may be generally evenly spaced on the cover 14 of the dispensing vessel 10. During use of the dispensing vessel 110 in a clothes dryer, the one or more protuberances 18 help to lift and separate individual clothing articles, thereby assisting with airflow between and among individual clothing articles in the clothes drying environment. Enhancing the airflow in the clothes drying environment permits moisture released from the dispensing vessel to be dispersed more evenly in a batch of clothing articles, which thereby enhances the effectiveness of the dispensing vessel 110 in removing wrinkles from individual clothing articles.

As illustrated in FIGS. 2-7, in one or more preferred implementations, each of the one or more protuberances 18 is shaped as a chunky knob that extends outwardly away from the cover 14 and includes a flattened tip 20 at an end thereof. The chunky shape and the flattened tip 20 of the one or more protuberances 18 may enhance lifting and separating of individual clothing articles in a batch of clothing articles. In particular, the chunky shape and flattened tip 20 may loosen a matted or clumped batch of clothing articles that may have been left in the clothes dryer for a lengthy period of time following termination of an initial drying cycle. During use of the dispensing vessel 110, the flattened tip 20 of the one or more protuberances 18 impacts and bangs into individual clothing articles to loosen and separate a matted or clumped batch of clothing articles, which thereby provides enhanced airflow to the clothes drying environment.

Other shapes, quantities, and arrangements of the one or more protuberances 18 are contemplated. For instance, at least some of the one or more protuberances 18 may have a generally conical shape. Selection of the shape, quantity, and arrangement of the one or more protuberances 18 may vary on the basis of the type or quantity of individual clothing articles to be refreshed. It is also within the scope of the present invention for some of the protuberances to a have a different shape than other protuberances of a single dispensing vessel 110.

As shown in FIGS. 2-7, which depict the one or more protuberances 18 as being integral with the cover 14, some of the one or more protuberances 18 may have an opening 17 defined therethrough that extends to an interior of the cover 14. Preferably, this opening provides for fluid communication between an interior and exterior of the dispensing vessel 110, e.g. allows liquids or gases to flow from the interior to the exterior or vice versa. In a preferred implementation, each of these openings 17 has a diameter of approximately one eighth of an inch (⅛").

Preferably, during use of the dispensing vessel 110, moisture may be released from the core 12 of the dispensing vessel 10 to the clothes drying environment through the openings 16 in the cover 14 and the openings 17 in the one or more protuberances 18. Moisture from the dispensing vessel 10 thereby assists with the removal of wrinkles from individual articles in the batch of clothing articles. It is further contemplated that the dispensing vessel 110 may have openings 16 in the cover 14 without having openings 17 in the one or more protuberances 18, and vice versa.

Figure 6:
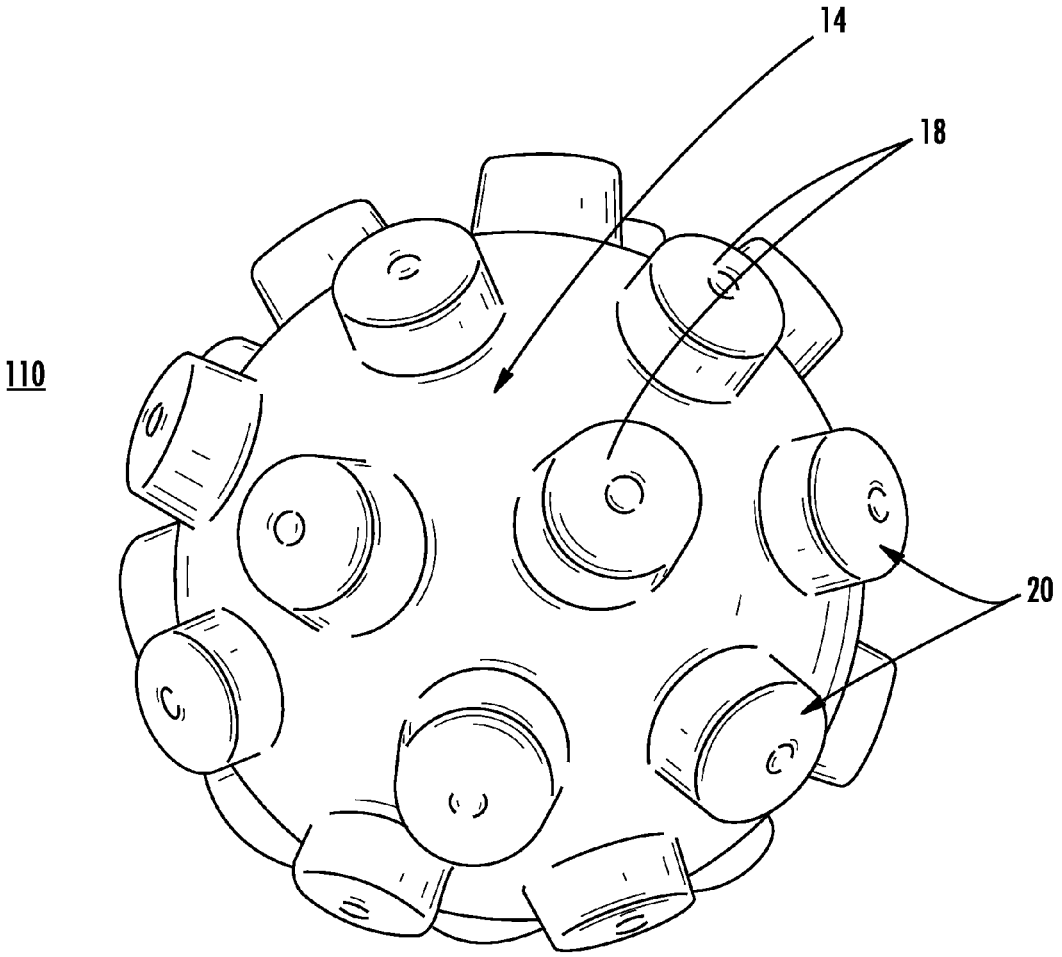
Figure 7:
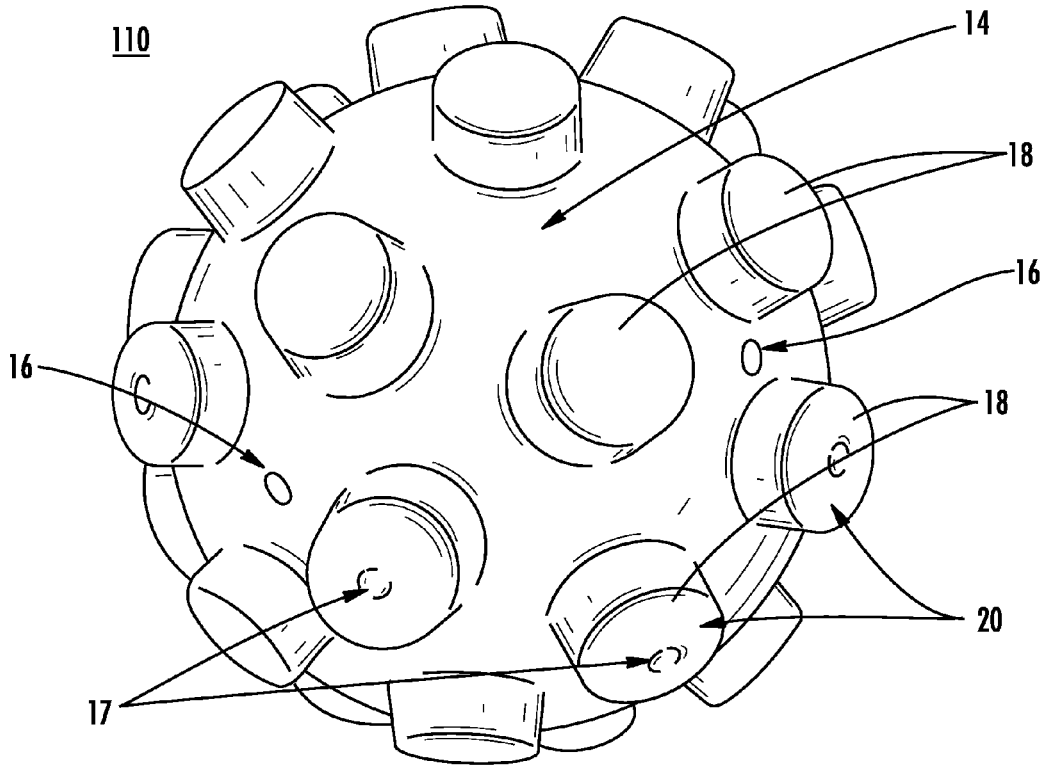

Further, as illustrated in FIGS. 6-7, it is also within the scope of the present invention not to include openings 16,17 opposite of the fill opening 22. In this regard, the moistening substance added to the core 12 through the fill opening 22 is less likely to seep out of the dispensing vessel 10 prior to use. In a preferred implementation, each protuberance 18 includes an opening 17, except for seven protuberances disposed generally opposite the fill opening 22. In at least one of these preferred implementations, these seven protuberances 18 include a first protuberance 18 disposed generally diametrically opposite the fill opening 22, and further include the six protuberances 18 directly surrounding this first protuberance 18.

In at least some implementations in which the protuberances are attachable to the cover 14 as separate, individual components, some of the protuberances include an opening that extends through the protuberance. The openings of these protuberances may be aligned with one or more of the openings 16 of the cover 14 so as to establish a channel through which moisture may be released from the core 12 into the clothes drying environment.

Preferred Cores

As discussed above, the core 12 may be composed of any material that provides the ability to retain a moistening substance at least temporarily. Preferably, the core 12 is superabsorbent, and, more preferably, is capable of retaining at least ten to twenty times its weight in water. Preferably, the core 12 is composed of a material that allows it to retain at least eighty five percent to ninety percent (85-90%) of its volume in water. For example, if the core has a volume of 27 cubic inches, the core is preferably capable of retaining, at least, around 23 cubic inches of water. In a preferred implementation, the core 12 comprises melamine foam, which is believed to be capable of such retention.

Further, in one or more preferred implementations, a cubic core 12 is disposed within a cover 14 having a generally spherical interior space. In some preferred implementations, this cubic core is approximately three inches by three inches by three inches (3"×3"×3"). In various implementations, the cover 14 the core 12 is disposed within may have a diameter that is either greater than, less than, or approximately equal to, 3 inches (3"). In a preferred implementation, the cover 14 has an interior diameter of approximately three and one fourths inches (3¼"), while the cubic core is approximately three inches by three inches by three inches (3"×3"×3"). In such preferred implementations, a diameter length measured from the ends of diametrically opposed protuberances 18 preferably is approximately three and three fourths inches (3¾"). In at least some implementations, the diameter of openings 16 of the cover 14 may be selected at least in part based on the ability of the core 12 to absorb and retain water. As noted above, in at least some preferred implementations, openings 16 having a diameter of one eighth of an inch (⅛") are utilized.

In one or more preferred implementations, the core 12 is retained in a compressed condition within an interior of the cover 14.

Conclusion

Based on the foregoing description, it will be readily understood by those persons skilled in the art that the present invention is susceptible of broad utility and application. Many embodiments and adaptations of the present invention other than those specifically described herein, as well as many variations, modifications, and equivalent arrangements, will be apparent from or reasonably suggested by the present invention and the foregoing descriptions thereof, without departing from the substance or scope of the present invention. Accordingly, while the present invention has been described herein in detail in relation to one or more preferred embodiments, it is to be understood that this disclosure is only illustrative and exemplary of the present invention and is made merely for the purpose of providing a full and enabling disclosure of the invention. The foregoing disclosure is not intended to be construed to limit the present invention or otherwise exclude any such other embodiments, adaptations, variations, modifications or equivalent arrangements, the present invention being limited only by the claims appended hereto and the equivalents thereof.

What is claimed is:

1. A dispensing vessel for introducing moisture into a clothes drying environment, the dispensing vessel comprising:

(a) a core configured to at least temporarily retain a moistening substance therein; and (b) a cover substantially surrounding the core, the cover having a generally oblong shape and including (i) a fill opening defined therethrough, the fill opening providing access to an interior of the cover from an exterior of the cover, (ii) a plurality of protuberances, each protuberance having a generally conical shape, and (iii) one or more dispensing openings, each dispensing opening providing access to an exterior of the cover from an interior of the cover, and each dispensing opening being disposed at a tip of a protuberance of the plurality of protuberances.

2. The dispensing vessel according to claim 1, wherein the cover is comprised of a semi-rigid material.

3. The dispensing vessel according to claim 1, wherein each of the dispensing openings is not positioned generally opposite the fill opening.

4. The dispensing vessel according to claim 1, wherein a moistening substance is retained within the core.

5. The dispensing vessel according to claim 4, wherein the moistening substance includes a scented additive.

6. The dispensing vessel according to claim 1, wherein the core is comprised of a sponge-like material.

7. The dispensing vessel according to claim 1, wherein the core is retained in a compressed condition within the interior of the cover.

8. The dispensing vessel according to claim 1, wherein the core is capable of retaining at least ten times its weight in water.

9. The dispensing vessel according to claim 1, wherein the core is capable of retaining at least 85 percent its volume in water.

10. The dispensing vessel according to claim 1, wherein one or more protuberances of the plurality of protuberances include a flattened tip at a distal end thereof.

11. The dispensing vessel according to claim 1, wherein one or more protuberances of the plurality of protuberances include a non-flattened tip at a distal end thereof.

12. The dispensing vessel according to claim 1 wherein the plurality of protuberances are spaced generally evenly from one another.

13. A dispensing vessel for introducing moisture into a clothes drying environment, the dispensing vessel comprising:

(a) a core configured to at least temporarily retain a moistening substance therein; and (b) a cover substantially surrounding the core, the cover including (i) a fill opening defined therethrough, the fill opening providing access to an interior of the cover from an exterior of the cover, (ii) a plurality of protuberances, each protuberance having a generally conical shape, and (iii) one or more dispensing openings, each dispensing opening disposed on a protuberance of the plurality of protuberances, and each dispensing opening providing access to an exterior of the cover from an interior of the cover.

14. The dispensing vessel according to claim 13, wherein the cover has a generally oblong shape.

15. The dispensing vessel according to claim 13, wherein the core is comprised of a sponge-like material.

16. The dispensing vessel according to claim 13, wherein one or more protuberances of the plurality of protuberances include a flattened tip at a distal end thereof.

17. The dispensing vessel according to claim 13, wherein the plurality of protuberances are spaced generally evenly from one another.

18. A dispensing vessel for introducing moisture into a clothes drying environment, the dispensing vessel comprising:

(a) a core comprising a sponge-like material, the core configured to at least temporarily retain a moistening substance therein;

(b) a cover substantially surrounding the core and retaining the core in a compressed condition, the cover having a generally oblong shape and including (i) a fill opening defined therethrough, the fill opening providing access to an interior of the cover from an exterior of the cover, (ii) a plurality of protuberances spaced generally evenly from one another, each protuberance having a generally conical shape, and (iii) one or more dispensing openings, each dispensing opening disposed at a distal end of a protuberance of the plurality of protuberances, and each dispensing opening providing access to an exterior of the cover from an interior of the cover; and (c) a moistening substance retained within the core;

(d) wherein each of the dispensing openings is not positioned generally opposite the fill opening.

* * * * *